US008313292B2

(12) United States Patent
Glynn et al.

(10) Patent No.: US 8,313,292 B2
(45) Date of Patent: Nov. 20, 2012

(54) SYSTEM AND METHOD FOR ACCOMMODATING CHANGING RESOURCE CONDITIONS FOR A STEAM TURBINE

(75) Inventors: Brian K. Glynn, Fiskdale, MA (US); William G. Catlow, Princeton, MA (US); Robert K. Goto, Cambridge, MA (US)

(73) Assignee: Siemens Energy, Inc., Orlando, FL (US)

( * ) Notice: Subject to any disclaimer, the term of this patent is extended or adjusted under 35 U.S.C. 154(b) by 669 days.

(21) Appl. No.: 12/564,082

(22) Filed: Sep. 22, 2009

(65) Prior Publication Data

US 2011/0070064 A1 Mar. 24, 2011

(51) Int. Cl.
*F01D 25/24* (2006.01)

(52) U.S. Cl. ..... 415/210.1; 415/912

(58) Field of Classification Search ..... 415/912, 415/189, 210.1, 209.4, 190; 29/889.1, 889.21, 29/889.22

See application file for complete search history.

(56) References Cited

U.S. PATENT DOCUMENTS

| | | | | |
|---|---|---|---|---|
| 1,998,951 | A | | 4/1935 | Downer |
| 3,914,842 | A | * | 10/1975 | Bruckhoff et al. ..... 415/912 |
| 4,881,872 | A | | 11/1989 | Butikofer et al. |
| 5,024,579 | A | | 6/1991 | Groenendaal, Jr. et al. |
| 5,116,200 | A | | 5/1992 | Catlow et al. |
| 5,249,918 | A | | 10/1993 | Knorowski |
| 5,259,727 | A | | 11/1993 | Quinn |
| 5,392,513 | A | | 2/1995 | Mazzola et al. |
| 5,628,617 | A | | 5/1997 | Dalton et al. |
| 5,697,151 | A | | 12/1997 | Werner et al. |
| 5,788,456 | A | | 8/1998 | Maier |
| 6,769,869 | B2 | | 8/2004 | Tanuma et al. |
| 7,032,903 | B1 | | 4/2006 | Dalton et al. |
| 7,179,052 | B2 | | 2/2007 | Sasaki et al. |
| 7,207,773 | B2 | | 4/2007 | O'Clair et al. |
| 7,458,219 | B2 | | 12/2008 | Herzog et al. |
| 7,458,770 | B2 | | 12/2008 | Russo et al. |
| 2007/0224037 | A1 | | 9/2007 | Suzuki et al. |

* cited by examiner

*Primary Examiner* — Richard Edgar

(57) ABSTRACT

A system and method for configuring a steam turbine to accommodate changing resource conditions, such as may be encountered with geothermal wells. A plurality of sets of nozzle/blade assemblies are provided for installation in a diaphragm structure and on a rotor, respectively. As the condition of steam provided to the turbine changes, a different set of nozzle/blade assemblies may be installed to maintain a preferred thermodynamic efficiency for the turbine.

18 Claims, 6 Drawing Sheets

SYSTEM AND METHOD FOR ACCOMMODATING CHANGING RESOURCE CONDITIONS FOR A STEAM TURBINE

FIELD OF THE INVENTION

The present invention relates generally to steam turbines and, more particularly, to a system and method for configuring a steam turbine to accommodate changing resource conditions, such as may be encountered with geothermal wells.

BACKGROUND OF THE INVENTION

Geothermal power plants generally utilize a steam turbine receiving steam from a geothermal well. The well conditions in geothermal applications or projects are variable and are often unknown at the time that a steam turbine is being designed for the project. In particular, current design practice often requires that final well conditions be determined prior to completing the design, with a resulting delay between the time that the final well conditions are obtained and the time that the turbine is installed, requiring the additional steps of finalizing the design and completing construction of the turbine prior to shipping it to the site for installation.

Accordingly, during the design process for a conventional geothermal project there exists the possibility that the resource conditions will change from the time that the turbine design is finalized to the time that it is placed in operation. Furthermore, the well conditions may vary over time, such that the thermodynamic efficiency of the turbine may decrease over the life of the geothermal power plant as the steam conditions vary from those of the steam turbine design point. Such changes may particularly affect the thermodynamic efficiency of first one to four stages of the steam turbine, and may substantially increase the energy costs as the efficiency of these stages is no longer optimized.

SUMMARY OF THE INVENTION

In accordance with one aspect of the invention, a method of providing a nozzle/blade configuration in a steam turbine is provided to accommodate different steam conditions from a steam source for supplying steam to the steam turbine, the method comprising:

providing a steam turbine including a steam turbine stage comprising: a rotor for detachably supporting a blade assembly; an outer diaphragm ring structure including an inwardly facing diaphragm surface defining a first diaphragm radius; an inner diaphragm ring structure including an outwardly facing diaphragm surface defining a second diaphragm radius; a radial diaphragm gap defined between the inwardly and outwardly facing diaphragm surfaces for receiving a nozzle assembly;

providing at least two sets of paired nozzle/blade assemblies for the steam turbine stage, each set of the nozzle/blade assemblies comprising: a nozzle assembly comprising a plurality of nozzles defining a nozzle height for a nozzle passage and a nozzle diameter, the nozzle diameter comprising a radial location of the nozzle passage relative to a rotational axis of the rotor; a blade assembly comprising a plurality of rotor blades, each rotor blade including an airfoil having an airfoil height and an airfoil radial location corresponding to the nozzle height and nozzle diameter, respectively;

determining a steam condition at the steam source;

selecting a set of the paired nozzle/blade assemblies with reference to the steam condition at the steam source; and installing the selected nozzle assembly in the diaphragm gap and installing the selected blade assembly on the rotor to effect an optimized operation of the steam turbine with reference to the steam condition at the steam source.

Each nozzle may comprise a radially extending nozzle vane; an outer block rigidly affixed to an outer end of the nozzle vane and including structure to support the outer block to the inwardly facing diaphragm surface; an inner block rigidly affixed to an inner end of the nozzle vane and including structure to support the inner block to the outwardly facing diaphragm surface; the nozzle height being defined as a radial distance along the nozzle vane from the inner block to the outer block; and the nozzle diameter being defined as twice a radial distance from a rotational axis of the rotor to a radially inner edge of the nozzle vane.

A dimension for at least one of the nozzle height and the nozzle diameter in each set of the nozzle/blade assemblies is different from a corresponding dimension in any other set of the nozzle/blade assemblies.

The outer block may comprise a first outer block surface adjacent to the inwardly facing diaphragm surface and a second outer block surface adjacent to the nozzle vane; the inner block may comprise a first inner block surface adjacent to the outwardly facing diaphragm surface and a second inner block surface adjacent to the nozzle vane; a nozzle span may be defined between the first outer block surface and the first inner block surface, the nozzle span being substantially equal to a diaphragm gap height defined as a difference between the first and second diaphragm radii; and wherein the nozzle span of the nozzles in each set of the nozzle/blade assemblies is the same as the nozzle span of the nozzles in any other set of the nozzle/blade assemblies.

Each rotor blade may further comprise a root portion and a shank extending between the root portion and the airfoil. The root portion includes structure for detachable attachment to the rotor, and the airfoil height is defined as a radial distance between the shank and a blade tip adjacent to a radially outer end of the rotor blade.

A length of the shanks for the rotor blades in each set of the nozzle/blade assemblies may be different from the length of the shanks for the rotor blades in any other set of the nozzle/blade assemblies.

The airfoil height of the rotor blades may be substantially equal to the nozzle height of the nozzles in each set of the nozzle/blade assemblies.

The selected set of paired nozzle/blade assemblies may comprise a first set of the nozzle/blade assemblies, and the method may include operating the steam turbine for a period of time with the first set of paired nozzle/blade assemblies until a predetermined change in the steam conditions from the steam source is identified, selecting a second set of the nozzle/blade assemblies, and installing the second set of the nozzle/blade assemblies in the diaphragm gap and the rotor in place of the first set of the nozzle/blade assemblies, the second set of the nozzle/blade assemblies may comprise a different nozzle height than the nozzle height of the first set of the nozzle/blade assemblies; and a different airfoil height than the airfoil height of the first set of the nozzle/blade assemblies.

The change in steam conditions may comprise a decrease in steam temperature from the steam source, and the second set of the nozzle/blade assemblies may comprise a smaller nozzle diameter than the nozzle diameter of the first set of the nozzle/blade assemblies; a larger nozzle height than the nozzle height of the first set of the nozzle/blade assemblies;

and a larger airfoil height than the airfoil height of the first set of the nozzle/blade assemblies.

In accordance with another aspect of the invention, a method of changing the efficiency of a steam turbine is provided, the steam turbine comprising: a rotor supporting a first blade assembly comprising a plurality of rotor blades; an outer diaphragm ring structure including an inwardly facing diaphragm surface defining a first diaphragm radius; an inner diaphragm ring structure including an outwardly facing diaphragm surface defining a second diaphragm radius; a radial diaphragm gap defined between the inwardly and outwardly facing diaphragm surfaces; a diaphragm gap height defined as a difference between the first and second diaphragm radii; a first nozzle assembly adjacent to the blade assembly and comprising a plurality of first nozzles located within the diaphragm gap for directing steam onto the rotor blades of the blade assembly; each nozzle comprising a radially extending nozzle vane, an outer block rigidly affixed to an outer end of the nozzle vane, and an inner block rigidly affixed to an inner end of the nozzle vane; the outer block comprising a first outer block surface adjacent to the inwardly facing diaphragm surface and a second outer block surface adjacent to the nozzle vane; the inner block comprising a first inner block surface adjacent to the outwardly facing diaphragm surface and a second inner block surface adjacent to the nozzle vane; a nozzle span defined between the first outer block surface and the first inner block surface, the nozzle span being substantially equal to the diaphragm gap height; a nozzle height defined between the second outer block surface and the second inner block surface; and the outer and inner blocks being detachably supported to the outer and inner diaphragm ring structures, respectively, the method comprising:

replacing the first nozzles of first nozzle assembly with second nozzles of a second nozzle assembly wherein the nozzle span of the second nozzles is the same as the nozzle span of the first nozzles, and the nozzle height of the second nozzles is different from the nozzle height of the first nozzles to effect a change in the efficiency of the steam turbine.

The method further includes replacing the first blade assembly with a second blade assembly wherein the airfoil height of the second blade assembly is different from the airfoil height of the first blade assembly.

In accordance with a further aspect of the invention, a system is disclosed for providing a nozzle/blade configuration to accommodate different steam conditions from a steam source for supplying steam to the steam turbine, the steam turbine including a steam turbine stage comprising: a rotor for detachably supporting a blade assembly; an outer diaphragm ring structure including an inwardly facing diaphragm surface defining a first diaphragm radius; an inner diaphragm ring structure including an outwardly facing diaphragm surface defining a second diaphragm radius; a radial diaphragm gap defined between the inwardly and outwardly facing diaphragm surfaces for receiving a nozzle assembly; and a diaphragm gap height defined as a difference between the first and second diaphragm radii. The system comprises at least two sets of paired nozzle/blade assemblies for the steam turbine stage, each set of the nozzle/blade assemblies comprising:

a nozzle assembly comprising a plurality nozzles for installation in the diaphragm gap, each nozzle comprising an outer block comprising a first outer block surface for engagement adjacent to the inwardly facing diaphragm surface and a second outer block surface adjacent to the nozzle vane, an inner block comprising a first inner block surface for engagement adjacent to the outwardly facing diaphragm surface and a second inner block surface adjacent to the nozzle vane, a nozzle span defined between the first outer block surface and the first inner block surface, and each nozzle defining a nozzle height between the second outer block surface and the second inner block surface; and a blade assembly comprising plurality of rotor blades for attachment to the rotor, each rotor blade including an airfoil having an airfoil height corresponding to the nozzle height of the nozzles;

wherein the nozzle span of the nozzles in each set of the nozzle/blade assemblies is substantially equal to the diaphragm gap height, and the nozzle height in each set of the nozzle/blade assemblies is different from the nozzle height in any other set of the nozzle/blade assemblies.

The airfoil height of the rotor blades in each set of the nozzle/blade assemblies may be different from the airfoil height of the rotor blades in any other set of the nozzle/blade assemblies.

BRIEF DESCRIPTION OF THE DRAWINGS

While the specification concludes with claims particularly pointing out and distinctly claiming the present invention, it is believed that the present invention will be better understood from the following description in conjunction with the accompanying Drawing Figures, in which like reference numerals identify like elements, and wherein:

DETAILED DESCRIPTION OF THE INVENTION

In the following detailed description of the preferred embodiment, reference is made to the accompanying drawings that form a part hereof, and in which is shown by way of illustration, and not by way of limitation, a specific preferred embodiment in which the invention may be practiced. It is to be understood that other embodiments may be utilized and that changes may be made without departing from the spirit and scope of the present invention.

Figure 1:
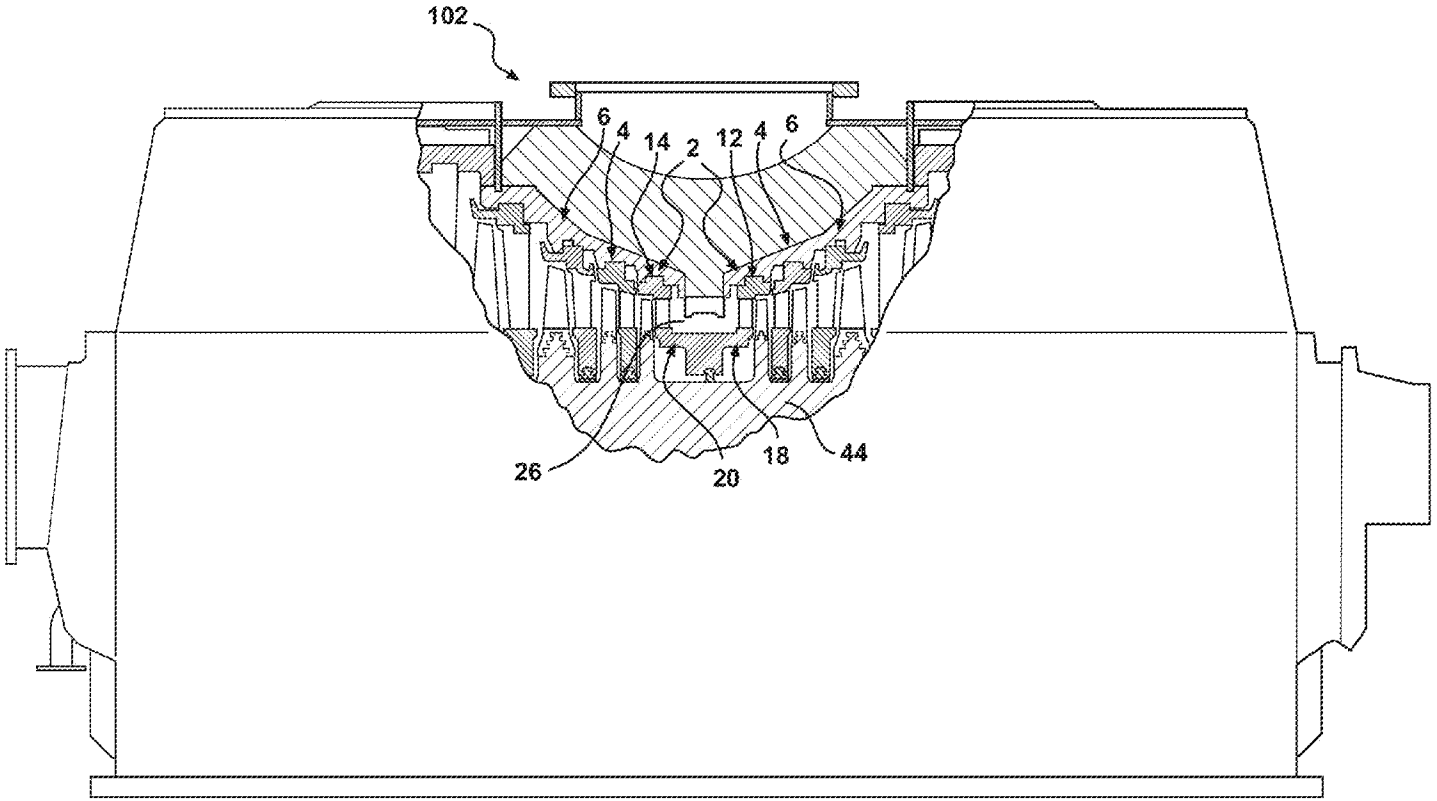
FIG. 1 is a partially cut-away view of a steam turbine that may incorporate the present invention.

Referring to FIG. 1, turbine 102 is illustrated comprising a double-flow steam turbine in which the present invention may be implemented. The cut-away view of the FIG. 1 shows first stages 2, second stages 4 and third stages 6 of the turbine 102, progressing from a central steam supply region of the turbine 102 outwardly in axially opposite directions, wherein it is understood that the turbine 102 may include a plurality of additional stages for extracting energy from steam supplied to the turbine 102.

Figure 2:
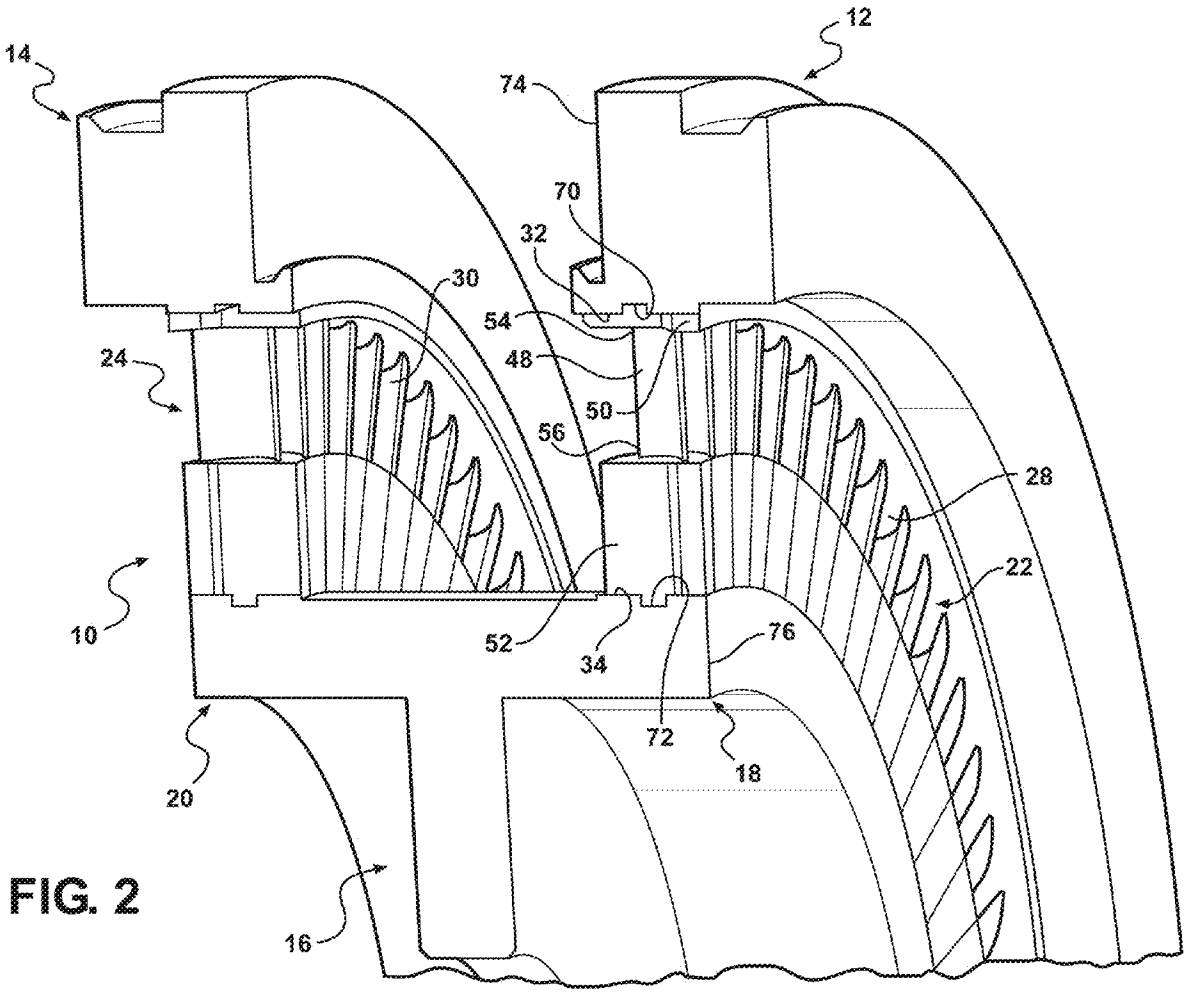
FIG. 2 is a perspective view of a portion of a diaphragm structure incorporating the invention.

Referring further to FIG. 2, a first stage diaphragm structure 10 for the turbine 102 is shown and, in the illustrated embodiment, comprises a double-flow diaphragm structure 10 for distributing steam in axially opposite directions within the turbine 102. It should be noted that although the embodiment illustrated herein refers to a double-flow turbine, including a double-flow diaphragm structure 10, the invention described is not limited to such a structure and may be implemented in other steam turbine configurations, such as in a single or axial flow turbine having a steam flow path directed in a single axial direction.

As seen in FIG. 2, the diaphragm structure 10 comprises a pair of circumferentially extending outer diaphragm ring structures 12, 14, a circumferentially extending inner diaphragm web 16 including oppositely extending inner diaphragm ring structures 18, 20, and a pair of nozzle assemblies 22, 24 supported between the respective outer and inner diaphragm ring structures 12, 18 and 14, 20. The inner diaphragm structures 18, 20 may be supported in fixed relation from the outer diaphragm ring structures 12, 14 by conventional radial structural ribs (not shown), as is known in the art. The illustrated diaphragm structure 10 comprises a first stage for the steam turbine wherein steam is received in an annular chamber 26 defined centrally within the diaphragm structure 10, flows circumferentially around the diaphragm structure 10, and is directed axially outwardly in opposite directions through nozzle passages 28, 30 defined through the nozzle assemblies 22, 24. The present invention will be further described with particular reference to the outer diaphragm ring structure 12, the inner diaphragm ring structure 14 and the nozzle assembly 22, it being understood that the described structure may be implemented at other locations within the turbine. Further, although the present description is directed to a single (first) stage of the steam turbine 102, it is contemplated that the present invention may be implemented in plural stages of the steam turbine 102.

Figure 4:
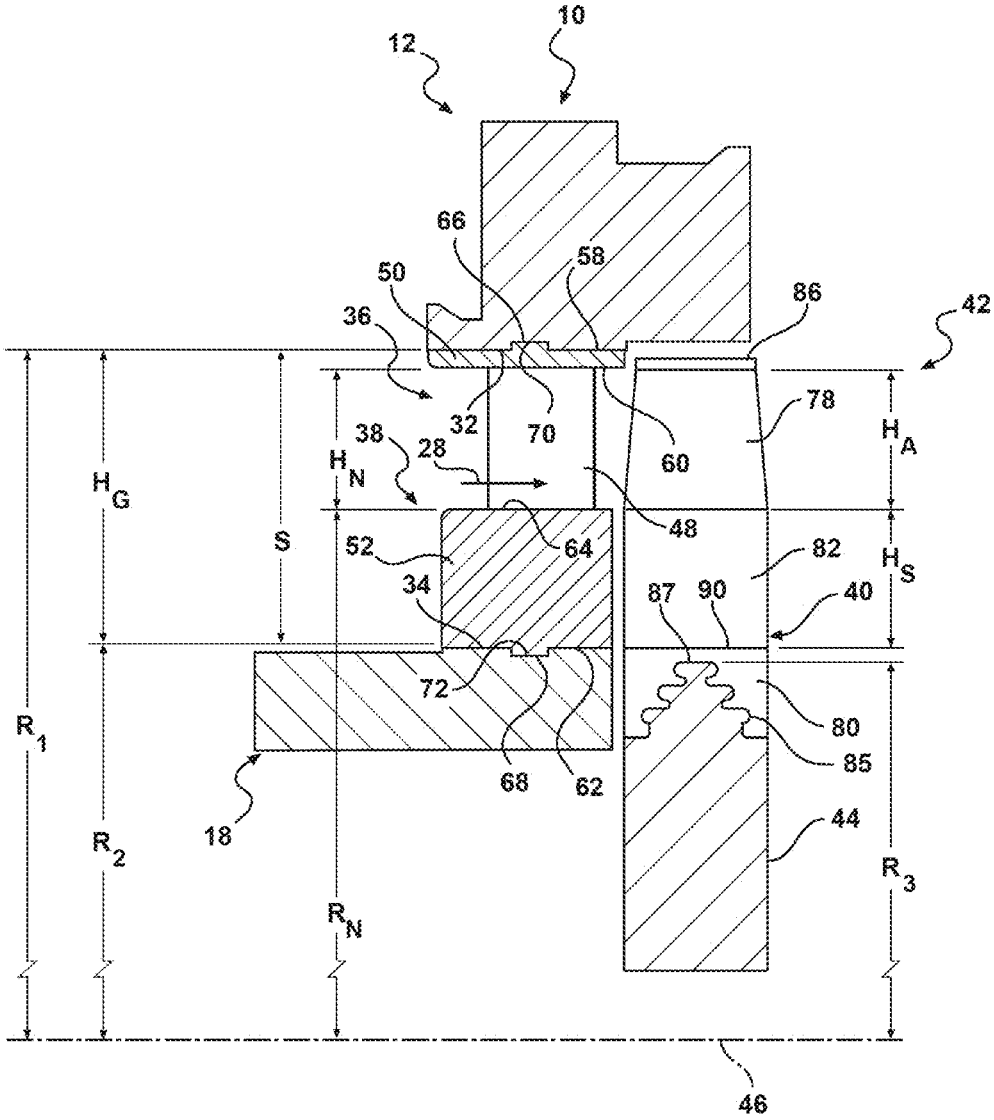
FIG. 4 is a cross-sectional side view illustrating a nozzle/blade configuration of the invention.

Referring further to FIG. 4, the outer diaphragm ring structure 12 includes an inwardly facing diaphragm surface 32 defining a first diaphragm radius, $R_1$, and the inner diaphragm ring structure 18 includes an outwardly facing diaphragm surface 34 defining a second diaphragm radius, $R_2$. A radial diaphragm gap 36 is defined between the inwardly and outwardly facing diaphragm surfaces 32, 34. In addition, the gap 36 defines a diaphragm gap height, $H_G$, as a difference between the first and second diaphragm radii, $R_1$ and $R_2$, of the inwardly and outwardly facing surfaces 32, 34.

The nozzle assembly 22 comprises a plurality of nozzles 38 positioned circumferentially in side-by-side relation within the diaphragm gap 36. The nozzles 38 direct steam from the annular chamber 26 onto a plurality of rotor blades 40 supported on a rotor 44 and forming a rotor blade assembly 42. The rotor 44 supports the blades 40 adjacent to an outlet of the nozzles 38 for rotation about a rotational axis 46.

Figure 3:
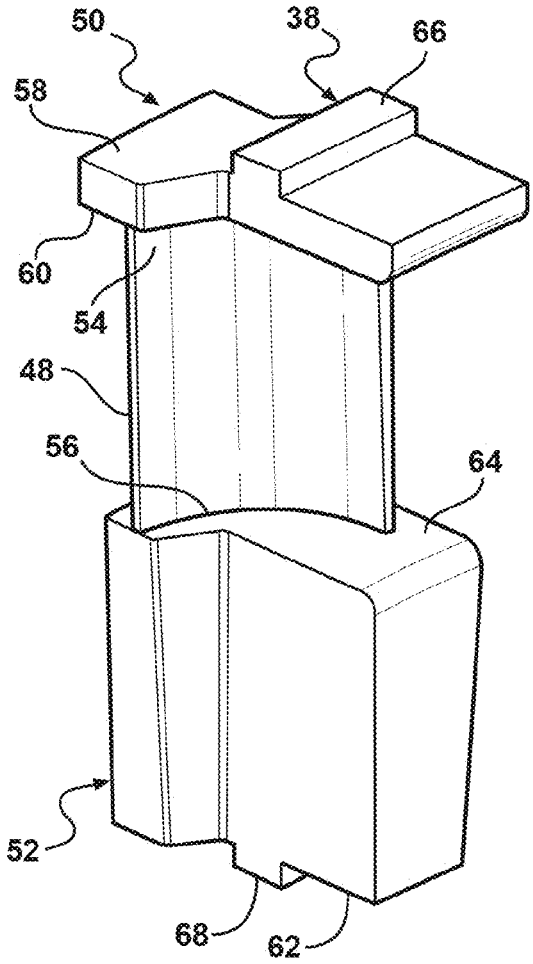
FIG. 3 is a perspective view of a nozzle for the diaphragm structure of FIG. 2.

As seen in FIG. 3, each nozzle 38 comprises a radially extending nozzle vane 48 located between an outer block 50 and an inner block 52. The outer block 50 is rigidly affixed to an outer end 54 (FIG. 2) of the nozzle vane 48, and the inner block 52 is rigidly affixed to an inner end 56 of the nozzle vane 48. The outer block 50 comprises a first outer block surface 58 located adjacent to the inwardly facing diaphragm surface 32, and a second outer block surface 60 located adjacent to the outer end 54 of the nozzle vane 48. Similarly, the inner block 52 comprises a first inner block surface 62 located adjacent to the outwardly facing diaphragm surface 34, and a second inner block surface 64 located adjacent to the inner end 56 of the nozzle vane 48.

As seen in FIG. 4, a nozzle span, S, is defined between the first outer block surface 58 and the first inner block surface 62 wherein the nozzle span S is substantially equal to the diaphragm gap height $H_G$. A nozzle height $H_N$ is defined between the outer end 54 of the vane 48 at the second outer block surface 60 and the inner end 56 of the vane 48 at the second inner block surface 64. In addition, a nozzle diameter is defined as comprising a diameter of the diaphragm structure 10 that is twice a radial dimension $R_N$ from the rotational axis 46 to the second inner block surface 64. That is, the nozzle diameter is defined as $2R_N$.

The outer and inner blocks 50, 52 are detachably supported to the outer and inner diaphragm ring structures 12, 18 for removable mounting of the nozzle 38 into the diaphragm structure 10. As seen in FIG. 3, the outer block 50 may be formed with a radially extending outer rib 66 extending from the first outer block surface 58, and the inner block 52 may be formed with a radially extending inner rib 68 extending from the first inner block surface 62. The outer and inner ribs 66, 68 slidably engage within outer and inner grooves 70, 72 (FIG. 4) formed in the inwardly and outwardly facing diaphragm surfaces 32, 34, respectively. In particular, the diaphragm structure 10 may comprise two halves, each extending 180° around an inner circumference of the steam turbine 102. The nozzle assembly 22 may be built up by sliding the nozzles 38 inwardly from respective edges 74, 76 of the outer and inner diaphragm ring structures 12, 18 along the grooves 70, 72. The nozzles 38 are located in side-by-side relation around the circumference of the diaphragm structure 10 to form the nozzle passages 28, defined between adjacent ones of the vanes 48.

Figure 6:
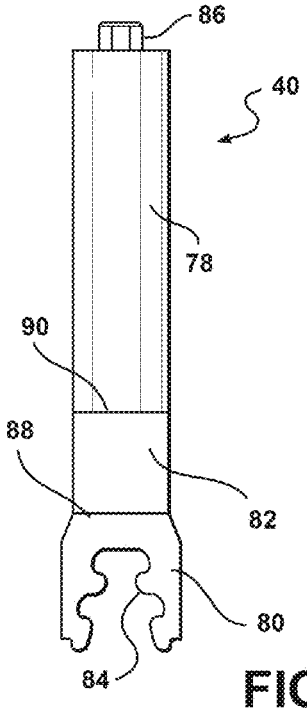
FIG. 6 is an elevational view of a rotor blade for the configuration of FIG. 4.

Referring to FIGS. 4 and 6, each blade 40 comprises an airfoil 78, a root portion 80, and a shank 82 extending between the root portion 80 and the airfoil 78. The root portion 80 includes structure for 84 detachable attachment to the rotor 44. The structure 84 may comprise a fur-tree or serrated configuration on the root portion 80 for cooperating with a corresponding mounting configuration 85 on the rotor 44. The structure 84 of the root portion 80 may be slidably fit onto the mounting configuration 85 of the rotor 44 in a conventional manner, as is known in the art. Alternatively, the structure 84 for attachment of the rotor blades 40 to the rotor 44 may comprise other shapes for retaining the rotor blades 40 in position during rotation of the rotor 44. The rotor 44 has an outer edge 87 located at a predetermined radial location or distance $R_3$ from the rotational axis 46, and the outer edge 87 is located such that it may accommodate a range of airfoil sizes, including an airfoil size for use in combination with nozzles 38 having a minimum nozzle diameter $2R_N$. That is, in an embodiment of the invention, the rotor 44 may support a blade 40 comprising an airfoil 78 having an inner end 90 located at a radial location close to that of the outwardly facing surface 34 of the inner ring structure 18, as is discussed in further detail below.

The airfoils 78 of rotor blades 40 have a height, $H_A$, defined as a radial distance from the shank 82, at the inner end 90 of the airfoil 78, to a blade tip 86 adjacent to a radially outer end of the rotor blade 40. The airfoil height, $H_A$, preferably corresponds to, i.e., is substantially equal to, the nozzle height, $H_N$. The shank 82 may comprise a generally rectangular structural portion of the rotor blade 40 (see also FIG. 7) for supporting the airfoil 78 to the root portion 80, and has a height, $H_S$, defined as a distance between an outer end 88 of the root portion 80 and the inner end 90 of the airfoil 78.

The structure of the nozzle assembly 22 and the blade assembly 42 is determined with reference to the condition of steam provided from a steam source.

That is, the efficiency of the steam turbine 102 is substantially dependent on the condition of the steam provided to the turbine and provision of a corresponding optimum nozzle height, $H_N$, nozzle diameter, $2R_N$, and associated rotor blade airfoil height, $H_A$, for the first turbine stage. Further, the steam condition typically also affects the optimum design for a plurality of the turbine stages. In particular, as noted above, for geothermal power applications of the steam turbine, the steam condition may vary through the life cycle of the geothermal power plant. In accordance with an embodiment of the present invention, a plurality of sets of paired nozzle assemblies 22 and blade assemblies 42 are preferably provided (hereinafter referred to as nozzle/blade assemblies 22, 42) to accommodate varying steam condition supplied to the turbine 102.

Figure 5:
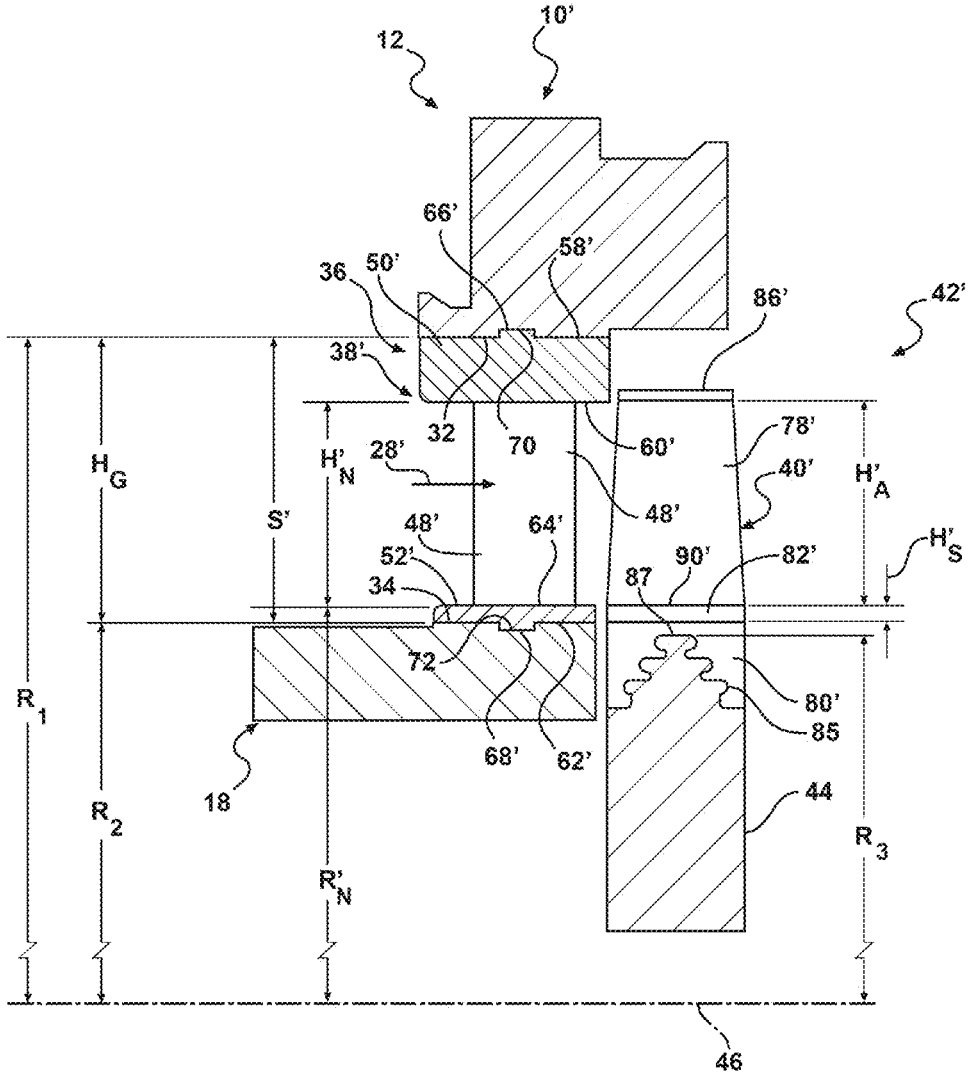
FIG. 5 is a cross-sectional side view illustrating an alternative nozzle/blade configuration of the invention.
Figure 7:
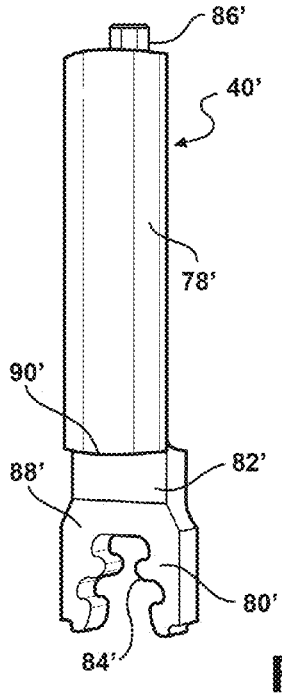
FIG. 7 is an elevational view of a rotor blade for the configuration of FIG. 5.

Referring to FIGS. 5 and 7, an alternative configuration for a nozzle/blade assembly 22, 42 is illustrated, comprising an exemplary alternative nozzle/blade assembly, in which elements of the diaphragm ring structures 12, 18 and rotor 44 corresponding to elements in FIGS. 4 and 6 are identified with the same reference labels, and elements of the nozzle/blade assembly corresponding to elements in FIGS. 4 and 6 are identified with the same reference labels primed. It can be seen that, in comparison to the corresponding dimensions illustrated in FIGS. 4 and 6, the nozzle span, S', of the present configuration is the same as span, S, of the previous configuration, the nozzle height, $H_N'$, of the present configuration is larger than the nozzle height, $H_N$, of the previous configuration, the nozzle diameter, $2R_N'$, of the present configuration is smaller than the nozzle diameter, 2 $R_N$, of the previous configuration, and the airfoil height, $H_A'$, of the present configuration is larger than the airfoil height, $H_A$, of the previous configuration. In addition, the shank height, $H_S'$, of the present configuration is smaller than the shank height, $H_S$, in the previous configuration.

It should be noted that the diaphragm ring structures 12, 18, including the location of the first and second diaphragm radii $R_1$ and $R_2$, and the dimension, $H_G$, of the diaphragm gap 36 remains fixed, as does the location of the outer end 87 of the rotor 44 at the predetermined radial distance $R_3$ from the rotational axis 46. Hence, a fixed structure of the diaphragm ring structures 12, 18 and the rotor 44 is provided for mounting both of the paired sets of nozzle/blade assemblies 22, 42 and 22', 42', and the nozzle/blade assembly may be selected to provide the desired steam flow through the nozzle assembly 22, 22' and associated blade assembly 42, 42', depending on the steam condition provided from the steam source.

In particular, the passage through the diaphragm gap 36 may be modified by providing different thicknesses for the outer and inner blocks 50, 52 to define the nozzle height, $H_N$, and the thickness of the inner block 52 may additionally be selected to define a desired nozzle diameter $2R_N$. For example, for a higher temperature steam condition, e.g., 420° C. steam from a geothermal well, the first described set of nozzle/blade assemblies 22, 42 may be mounted in the diaphragm ring structures 12, 18 in combination with the blade 40 mounted to the rotor 44. This configuration provides a smaller passage 28, i.e., smaller nozzle height $H_N$, defined through the nozzles 38 located at a larger nozzle diameter, $2R_N$, and operating in combination with blades 40 having an airfoil 78 with a smaller airfoil height, $H_A$, supported on a larger shank 82.

As the condition of the steam changes over time, such as to a predetermined condition providing a lower temperature steam, e.g., steam at 360° C. from a geothermal well, the second described set of nozzle/blade assemblies 22', 42' may be mounted in the diaphragm ring structures 12, 18 in combination with the blade 40' mounted to the rotor 44. This configuration provides a larger passage 28', i.e., larger nozzle height $H_N'$, defined through the nozzles 38' located at a smaller nozzle diameter, $2R_N'$, and operating in combination with blades 40' having an airfoil 78' with a larger airfoil height, $H_A'$, supported on a smaller shank 82'. In addition, the shape of the airfoil 78' may be designed, i.e., changed from the shape of the airfoil 78, to optimize the operation of the blade 40' in the changed steam conditions. Each of the paired sets of the nozzle/blade assemblies 22, 42 and 22', 42' may be selected to optimize or improve the energy transmitted from the steam to the rotor 44 for the particular steam conditions available from the steam source, without requiring a change to the support structure for the nozzle assemblies 22, 22' and blade assemblies 42, 42'.

Figure 8:
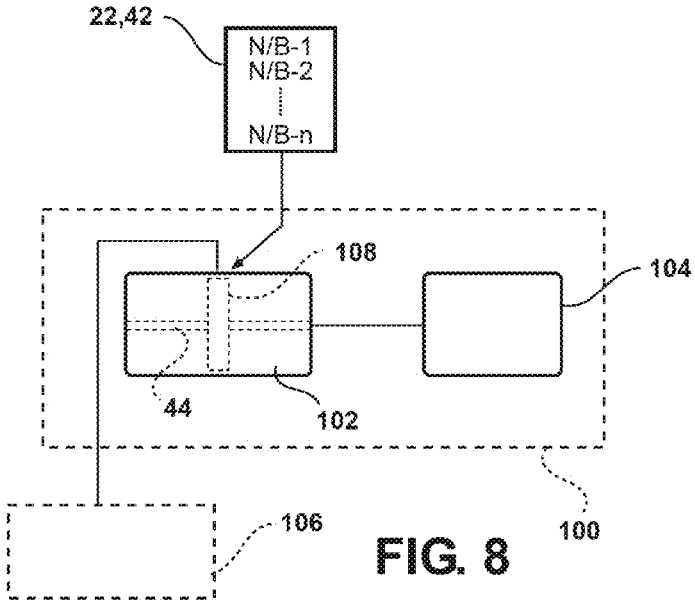
FIG. 8 is a schematic view of a geothermal power plant and a system for providing sets of nozzle/blade assemblies to a steam turbine.

An implementation of the present invention is shown diagrammatically in FIG. 8, illustrating a geothermal power plant 100 including the steam turbine 102 connected to a generator 104 for generation of electrical power from the geothermal power plant 100. The power plant 100 is located near a geothermal well 106 comprising a steam source for providing steam to the steam turbine 102. In an embodiment of the present invention, a method of configuring a stage 108, i.e, a first stage or plural stages, of the steam turbine 102 is performed including providing a plurality of the paired sets of nozzle/blade assemblies 22, 42 for a stage of the steam turbine 102, where the individual sets of nozzle/blade assemblies are designated N/B-1, N/B-2, N/B-n. Each of the plurality of sets of nozzle/blade assemblies, N/B-1, N/B-2, N/B-n, is designed or configured for a predetermined anticipated steam condition or range of steam conditions in a stage of the steam turbine 102 and comprises nozzles 38 and blades 40 matched or paired in the manner described above with reference to the paired sets of nozzle/blade assemblies 22, 42 and 22', 42'. Preferably, the plurality of sets of nozzle/blade assemblies N/B-1, N/B-2, N/B-n, each comprise a unique set wherein one or more of the nozzle height $H_N$, the nozzle diameter $2R_N$, the airfoil height $H_A$, and the shank height $H_S$ for each set of nozzle/blade assemblies 22, 42 is different from the corresponding dimension(s) in any other set of nozzle/blade assemblies 22, 42.

In a new installation of the turbine 102 in the geothermal power plant 100, detailed information on the particular resource conditions, such as steam temperature, pressure and other factors, available from the well 106 may not be available until a time close to installation of the turbine 102 in the plant 100. In accordance with the present invention, the design process and manufacture of the turbine 102 may be substantially completed without knowledge of the final well conditions, such that the turbine design does not become critical path in the construction of the plant 100. Specifically, based on preliminary well condition information, the design of the turbine 102 may be initiated where the rotor 44 and diaphragm structures, i.e., the diaphragm structure 10 and other stage diaphragm structures, may be designed to accommodate sets of the nozzle/blade assemblies 22, 42 for a range of steam conditions (temperature and pressure) anticipated to be present at a time when the plant 100 is completed. In addition, a plurality of nozzle/blade assemblies, N/B-1, N/B-2, N/B-n, e.g., three sets of nozzle/blade assemblies, may be designed and manufactured for the anticipated range of well conditions, and one of the sets of nozzle/blade assemblies 22, 42 may be selected for installation in the turbine 102 at a final design and assembly step of the turbine 102. By providing a design and manufacturing technique that is not limited to a particular steam condition of the well, the design and manufacture of the turbine 102 may be completed at an earlier date, consequently allowing the plant to generate power at an earlier date and thereby effect an efficiency associated with the additional power generation that is made available from the plant 100. The additional, unused, sets of nozzle/blade assemblies 22, 42 not installed for the initial start-up of the plant 100 may be maintained in the inventory of the plant operator for potential use as a replacement set of nozzle/blade assemblies 22, 42 if the steam conditions of the well 106 change after operation of the plant 100 over a period of time. In particular, at least one of the nozzle/blade assemblies 22, 42 may be configured with reference to anticipated changes to the steam condition of the steam provided from the well 106 during the life of the geothermal power plant 100.

In accordance with a further embodiment of the invention, a condition of the steam provided from the well 106 may be monitored following a period of operation of the turbine 102 within the power plant 100. After the power plant 100 has been in operation over a period of time, the condition of the steam provided from the well 106 will typically change, e.g., the temperature and pressure of steam from the well 106 will decrease. The configuration (design point) of the turbine 102 is such that it provides an optimized efficiency for extracting energy from the steam based on particular steam conditions, including a particular steam temperature and/or pressure, where a change in the steam temperature and/or pressure, e.g., a drop in steam temperature and/or pressure, generally results in a loss of efficiency of the turbine 102. As noted above, at least one of the nozzle/blade assemblies 22, 42 included in the plurality of nozzle/blade assemblies, N/B-1, N/B-2, N/B-n, associated with the turbine 102 is preferably configured based on anticipated changing conditions of the well 106 during the life of the power plant 100. Accordingly, in accordance with a method of the invention, a second set of the nozzle/blade assemblies 22, 42 may be installed in the turbine 102 in place of the first set of nozzle/blade assemblies 22, 42 to improve the thermodynamic efficiency of the turbine 102.

As noted previously, although the present description makes reference to configuring a stage of the turbine 102 utilizing the plurality of nozzle/blade assemblies, N/B-1, N/B-2, N/B-n, changes in the steam condition typically may affect a plurality of the stages of the turbine. Hence, a distinct predetermined group of the plurality of nozzle/blade assemblies, N/B-1, N/B-2, N/B-n, may be provided for each of the stages of the steam turbine that may be affected by a change in the steam conditions, where each group comprises paired sets of the nozzle/blade assemblies 22, 42 specifically designed for a particular one of the stages and to accommodate a particular resource or steam condition.

In accordance the present nozzle/blade configuration system and method, the same mounting structure of the outer and inner diaphragm rings 12, 18 and the rotor 44 may be used for all configurations, requiring only substitution of the nozzle/blade assemblies 22, 42 to provide an improved efficiency. Advantageously, the present system and method provides variations in the placement of the airfoil 78 through use of different shank lengths or heights, $H_S$, without requiring replacement of the rotor 44 to accommodate the different blade configurations in the sets of the nozzle/blade assemblies 22, 42. To implement this aspect, the radial location $R_3$ of the rotor outer edge 87 is positioned such that a variety of blades 40 having a range of shank heights, $H_S$, may be mounted to the mounting configuration 85 on the rotor 44, where a minimum shank height, $H_S$, may accommodate a minimum nozzle diameter, $2R_N$, and corresponding larger nozzle height, $H_N$, and a maximum shank height, $H_S$, may accommodate a maximum nozzle diameter, $2R_N$, and corresponding smaller nozzle height, $H_N$.

It should be apparent from the above discussion that the present system and method for providing the nozzle/blade configurations to the turbine permit greater flexibility in design of the turbine, including shortening the delivery cycle for new turbine installations. Specifically, in accordance the present system and method, it is not necessary to have complete information on the well conditions before proceeding the design and manufacture of the turbine, and a range of nozzle/blade assemblies may be provided to accommodate a range of steam characteristics that will encompass anticipated available well conditions. Further, the range of structure provided by the sets of nozzle/blade assemblies for mounting in the turbine enables reconfiguration of the turbine steam path to maintain efficiency of the turbine with changing well conditions, while avoiding changes to structurally large components, such as the rotor, to minimize or reduce the cost of implementing the configuration changes within the turbine.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A method of providing a nozzle/blade configuration to accommodate different steam conditions from a steam source for supplying steam to the steam turbine, the method comprising:

providing a steam turbine including a steam turbine stage comprising:

a rotor for detachably supporting a blade assembly;

an outer diaphragm ring structure including an inwardly facing diaphragm surface defining a first diaphragm radius;

an inner diaphragm ring structure including an outwardly facing diaphragm surface defining a second diaphragm radius;

a radial diaphragm gap defined between the inwardly and outwardly facing diaphragm surfaces for receiving a nozzle assembly;

providing at least two sets of paired nozzle/blade assemblies for the steam turbine stage, each set of the nozzle/blade assemblies comprising:

a nozzle assembly comprising a plurality of nozzles defining a nozzle height for a nozzle passage and a nozzle diameter, the nozzle diameter comprising a radial location of the nozzle passage relative to a rotational axis of the rotor;

a blade assembly comprising a plurality of rotor blades, each rotor blade including an airfoil having an airfoil height and an airfoil radial location corresponding to the nozzle height and nozzle diameter, respectively;

determining a steam condition at the steam source;

selecting a set of the paired nozzle/blade assemblies with reference to the steam condition at the steam source; and installing the selected nozzle assembly in the diaphragm gap and installing the selected blade assembly on the rotor to effect an optimized operation of the steam turbine with reference to the steam condition at the steam source.

2. The method as in claim 1, wherein each nozzle comprises:

a radially extending nozzle vane;

an outer block rigidly affixed to an outer end of the nozzle vane and including structure to support the outer block to the inwardly facing diaphragm surface;

an inner block rigidly affixed to an inner end of the nozzle vane and including structure to support the inner block to the outwardly facing diaphragm surface;

the nozzle height being defined as a radial distance along the nozzle vane from the inner block to the outer block; and the nozzle diameter being defined as twice a radial distance from a rotational axis of the rotor to a radially inner edge of the nozzle vane.

3. The method as in claim 2, wherein a dimension for at least one of the nozzle height and the nozzle diameter in each set of the nozzle/blade assemblies is different from a corresponding dimension in any other set of the nozzle/blade assemblies.

4. The method as in claim 2, wherein:

the outer block comprises a first outer block surface adjacent to the inwardly facing diaphragm surface and a second outer block surface adjacent to the nozzle vane;

the inner block comprising a first inner block surface adjacent to the outwardly facing diaphragm surface and a second inner block surface adjacent to the nozzle vane;

a nozzle span defined between the first outer block surface and the first inner block surface, the nozzle span being substantially equal to a diaphragm gap height defined as a difference between the first and second diaphragm radii; and wherein the nozzle span of the nozzles in each set of the nozzle/blade assemblies is the same as the nozzle span of the nozzles in any other set of the nozzle/blade assemblies.

5. The method as in claim 1, wherein each rotor blade further comprises:

a root portion;

a shank extending between the root portion and the airfoil;

the root portion including structure for detachable attachment to the rotor; and the airfoil height being defined as a radial distance between the shank and a blade tip adjacent to a radially outer end of the rotor blade.

6. The method as in claim 5, wherein a length of the shanks for the rotor blades in each set of the nozzle/blade assemblies is different from the length of the shanks for the rotor blades in any other set of the nozzle/blade assemblies.

7. The method as in claim 5, wherein the airfoil height of the rotor blades is substantially equal to the nozzle height of the nozzles in each set of the nozzle/blade assemblies.

8. The method as in claim 1, wherein the selected set of paired nozzle/blade assemblies comprises a first set of the nozzle/blade assemblies, and including operating the steam turbine for a period of time with the first set of paired nozzle/blade assemblies until a predetermined change in the steam conditions from the steam source is identified, selecting a second set of the nozzle/blade assemblies, and installing the second set of the nozzle/blade assemblies in the diaphragm gap and the rotor in place of the first set of the nozzle/blade assemblies, the second set of the nozzle/blade assemblies comprising:

a different nozzle height than the nozzle height of the first set of the nozzle/blade assemblies; and a different airfoil height than the airfoil height of the first set of the nozzle/blade assemblies.

9. The method as in claim 8, wherein the change in steam conditions comprises a decrease in steam temperature from the steam source, and the second set of the nozzle/blade assemblies comprises:

a smaller nozzle diameter than the nozzle diameter of the first set of the nozzle/blade assemblies;

a larger nozzle height than the nozzle height of the first set of the nozzle/blade assemblies; and a larger airfoil height than the airfoil height of the first set of the nozzle/blade assemblies.

10. A method of changing the efficiency of a steam turbine, the steam turbine comprising: a rotor supporting a first blade assembly comprising a plurality of rotor blades; an outer diaphragm ring structure including an inwardly facing diaphragm surface defining a first diaphragm radius; an inner diaphragm ring structure including an outwardly facing diaphragm surface defining a second diaphragm radius; a radial diaphragm gap defined between the inwardly and outwardly facing diaphragm surfaces; a diaphragm gap height defined as a difference between the first and second diaphragm radii; a first nozzle assembly adjacent to the blade assembly and comprising a plurality of first nozzles located within the diaphragm gap for directing steam onto the rotor blades of the blade assembly; each nozzle comprising a radially extending nozzle vane, an outer block rigidly affixed to an outer end of the nozzle vane, and an inner block rigidly affixed to an inner end of the nozzle vane; the outer block comprising a first outer block surface adjacent to the inwardly facing diaphragm surface and a second outer block surface adjacent to the nozzle vane; the inner block comprising a first inner block surface adjacent to the outwardly facing diaphragm surface and a second inner block surface adjacent to the nozzle vane; a nozzle span defined between the first outer block surface and the first inner block surface, the nozzle span being substantially equal to the diaphragm gap height; a nozzle height defined between the second outer block surface and the second inner block surface; and the outer and inner blocks being detachably supported to the outer and inner diaphragm ring structures, respectively, the method comprising:

replacing the first nozzles of first nozzle assembly with second nozzles of a second nozzle assembly wherein the nozzle span of the second nozzles is the same as the nozzle span of the first nozzles, and the nozzle height of the second nozzles is different from the nozzle height of the first nozzles to effect a change in the efficiency of the steam turbine.

11. The method as in claim 10, including outer and inner block heights defined between the first and second surfaces of the respective outer and inner blocks, wherein at least one of the outer and inner block heights of the second nozzles is different from a corresponding one of the outer and inner block heights of the first nozzles.

12. The method as in claim 11, wherein both the outer block height and the inner block height of the second nozzles are different from the respective outer and inner block heights of the first nozzles.

13. The method as in claim 10, wherein the rotor blades comprise a root portion, an airfoil and a shank extending between the root portion and the airfoil, the root portion including structure for detachable attachment to the rotor, and the airfoil defining an airfoil height between the shank and a blade tip, and including:

replacing the first blade assembly with a second blade assembly;

wherein the airfoil height of the second blade assembly is different from the airfoil height of the first blade assembly.

14. The method as in claim 13, wherein the airfoil heights of the first and second blade assemblies are substantially equal to the respective nozzle heights of the first and second nozzles.

15. The method as in claim 13, wherein a radial location of the root portion of the rotor blades of the second blade assembly is the same as a radial location of the root portion of the rotor blades of the first blade assembly.

16. A system for providing a nozzle/blade configuration to accommodate different steam conditions from a steam source for supplying steam to the steam turbine, the steam turbine including a steam turbine stage comprising: a rotor for detachably supporting a blade assembly; an outer diaphragm ring structure including an inwardly facing diaphragm surface defining a first diaphragm radius; an inner diaphragm ring structure including an outwardly facing diaphragm surface defining a second diaphragm radius; a radial diaphragm gap defined between the inwardly and outwardly facing diaphragm surfaces for receiving a nozzle assembly; and a diaphragm gap height defined as a difference between the first and second diaphragm radii, the system comprising:

at least two sets of paired nozzle/blade assemblies for the steam turbine stage, each set of the nozzle/blade assemblies comprising:

a nozzle assembly comprising a plurality nozzles for installation in the diaphragm gap, each nozzle comprising an outer block comprising a first outer block surface for engagement adjacent to the inwardly facing diaphragm surface and a second outer block surface adjacent to the nozzle vane, an inner block comprising a first inner block surface for engagement adjacent to the outwardly facing diaphragm surface and a second inner block surface adjacent to the nozzle vane, a nozzle span defined between the first outer block surface and the first inner block surface, and each nozzle defining a nozzle height between the second outer block surface and the second inner block surface; and a blade assembly comprising plurality of rotor blades for attachment to the rotor, each rotor blade including an airfoil having an airfoil height corresponding to the nozzle height of the nozzles;

wherein the nozzle span of the nozzles in each set of the nozzle/blade assemblies is substantially equal to the diaphragm gap height, and the nozzle height in each set of the nozzle/blade assemblies is different from the nozzle height in any other set of the nozzle/blade assemblies.

17. The system as in claim 16, wherein the airfoil height of the rotor blades in each set of the nozzle/blade assemblies is different from the airfoil height of the rotor blades in any other set of the nozzle/blade assemblies.

18. The system as in claim 17, wherein each rotor blade comprises:

a root portion;

a shank extending between the root portion and the airfoil;

the root portion including structure for detachable attachment to the rotor;

the airfoil height being defined as a radial distance between the shank and a blade tip adjacent to a radially outer end of the rotor blade; and wherein a length of the shanks for the rotor blades in each set of the nozzle/blade assemblies is different from the length of the shanks for the rotor blades in any other set of the nozzle/blade assemblies.

* * * * *